US010244834B2

(12) United States Patent
Ng

(10) Patent No.: US 10,244,834 B2
(45) Date of Patent: Apr. 2, 2019

(54) BEAD BRACELET LOOM

(71) Applicant: Choon's Design LLC, Wixom, MI (US)

(72) Inventor: Cheong Choon Ng, Novi, MI (US)

(73) Assignee: Choon's Design LLC, Wixom, MI (US)

( * ) Notice: Subject to any disclaimer, the term of this patent is extended or adjusted under 35 U.S.C. 154(b) by 71 days.

(21) Appl. No.: 15/429,488

(22) Filed: Feb. 10, 2017

(65) Prior Publication Data

US 2017/0224071 A1 Aug. 10, 2017

Related U.S. Application Data

(60) Provisional application No. 62/293,424, filed on Feb. 10, 2016.

(51) Int. Cl.

| | |
|---|---|
| ***A44C 27/00*** | (2006.01) |
| ***A44C 5/00*** | (2006.01) |
| ***D04D 1/04*** | (2006.01) |
| ***D04D 11/00*** | (2006.01) |
| ***D04D 7/04*** | (2006.01) |
| ***A44C 11/00*** | (2006.01) |

(52) U.S. Cl.

CPC ..... *A44C 27/00* (2013.01); *A44C 5/00* (2013.01); *A44C 11/002* (2013.01); *D04D 1/04* (2013.01); *D04D 7/04* (2013.01); *D04D 11/00* (2013.01)

(58) Field of Classification Search

CPC .. A44C 27/00; A44C 5/00; A44C 5/02; A44C 5/022; A44C 5/025; A44C 5/027; A44C 5/04; A44C 5/08; A44C 5/10; A44C 5/102; A44C 5/104; A44C 5/107; A44C 11/002; D04D 7/00; D04D 7/04; D04D 9/00; D04D 11/00; D04D 15/0022; D04D 1/04

See application file for complete search history.

(56) References Cited

U.S. PATENT DOCUMENTS

| | | | | |
|---|---|---|---|---|
| 2,263,916 | A * | 11/1941 | Boyle | D03D 29/00 28/149 |
| 2,707,316 | A * | 5/1955 | Doniger | D03D 29/00 28/151 |
| 2,802,255 | A * | 8/1957 | Wallach | D03D 29/00 139/34 |
| 3,284,882 | A * | 11/1966 | Marchesan | A44C 11/00 29/241 |
| 3,545,069 | A | 12/1970 | Krieger | |
| D330,668 | S | 11/1992 | Nagamatsu | |
| 6,719,013 | B1 * | 4/2004 | D'Estais | D03D 29/00 139/29 |
| 7,147,008 | B2 | 12/2006 | Sayler | |

(Continued)

*Primary Examiner* — Ismael Izaguirre

(74) *Attorney, Agent, or Firm* — Carlson, Gaskey & Olds, P.C.

(57) ABSTRACT

A disclosed bead bracelet loom for making a beaded item includes a clip disposed at one end of a track and configured to hold a portion of a cord. A holder is disposed on the track and spaced apart from the clip. The holder includes a key portion that engages a portion of the track to maintain a position of the holder spaced apart from the clip. The holder including a spring portion that holds a clip configured to hold an end of the cord and maintain a desired tension on the cord member between the clip and the holder.

18 Claims, 10 Drawing Sheets

(56) References Cited

U.S. PATENT DOCUMENTS

| | | | | |
|---|---|---|---|---|
| D619,150 | S | 7/2010 | Crorey | |
| D626,574 | S | 11/2010 | Crorey | |
| 7,946,631 | B2 | 5/2011 | Crorey | |
| 8,066,035 | B1 | 11/2011 | Stevens | |
| 8,371,624 | B2 | 2/2013 | Karwowicz et al. | |
| 2009/0293982 | A1* | 12/2009 | Skaflestad | D03D 29/00 139/34 |
| 2010/0212770 | A1* | 8/2010 | Weidler | D03D 29/00 139/33 |
| 2010/0218840 | A1* | 9/2010 | Crorey | D04G 5/00 139/29 |
| 2010/0269947 | A1* | 10/2010 | Spear | D03D 29/00 139/29 |
| 2014/0166150 | A1* | 6/2014 | Teramoto | D04D 1/04 139/29 |

* cited by examiner

BEAD BRACELET LOOM

CROSS REFERENCE TO RELATED APPLICATION

This application claims priority to U.S. Provisional Application No. 62/293,424 filed on Feb. 10, 2016.

BACKGROUND

This disclosure generally relates to method and device for threading beads onto a string or cord for creating a beaded item.

Beads are sometimes threaded onto a string or cord to create bracelets, or other beaded items and jewelry. One type of beaded items includes beads that are attached between two cords by thread or other thinner string. The cords are typically larger and stiffer than the thinner thread utilized to attach the beads to the cord. Holding the cords in place while attaching the beads can be difficult and require significant dexterity and patience.

SUMMARY

A bead bracelet loom according to one disclosed example embodiment for creating a beaded bracelet or other beaded item includes a clip disposed at one end of a track and configured to hold a portion of a cord. A holder is disposed on the track and spaced apart from the clip. The holder includes a key portion that engages a portion of the track to maintain a position of the holder spaced apart from the clip. The holder includes a spring portion that holds a clip and is configured to maintain a desired tension on the cord between the clip and the holder.

These and other features disclosed herein can be best understood from the following specification and drawings, the following of which is a brief description.

DETAILED DESCRIPTION

Figure 1:
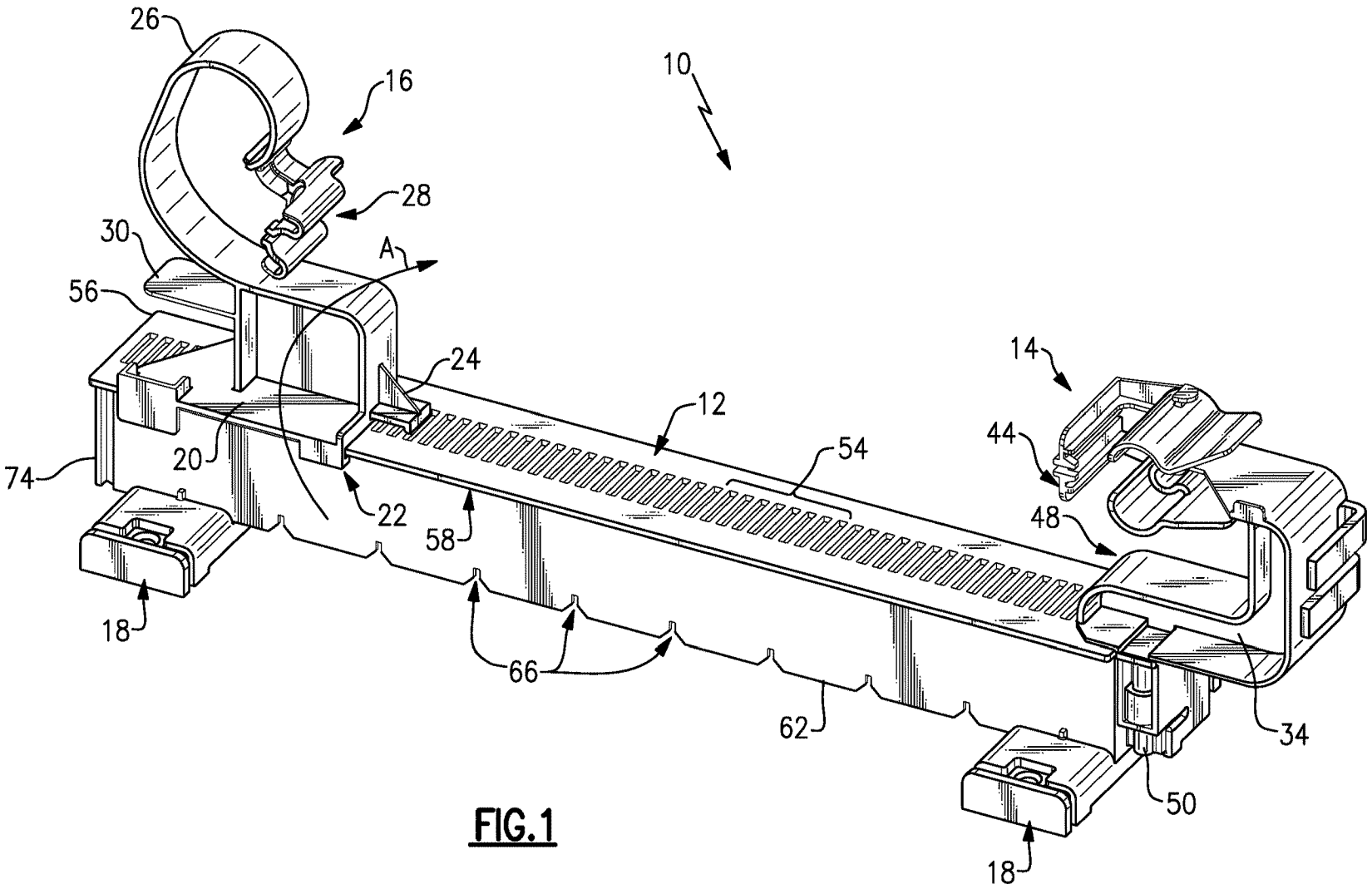
FIG. 1 is a perspective view of an example bead bracelet loom embodiment.

Referring to FIG. 1, an example loom 10 for creating a beaded item, such as a bracelet includes a track 12, a clip 14 and a holder 16. The clip 14 is disposed on one end of the track 12 and the holder 16 is supported on the track 12 a distance away from the clip 14. The clip 14 and the holder 16 provide for the holding of ends of a cord so that beads can be attached to the cord with thread.

One type of bracelet is commonly referred to as a wrap bracelet is created by attaching beads between two cords with thread. The beads are tied between two longitudinal cords to form the bracelet. The example disclosed loom 10 holds the longitudinal extending cords while the beads are tied and attached with thinner thread.

The example loom 10 includes the track 12 that is supported on legs 18. The legs 18 fit into a bottom portion 62 of the track 12 and engage notches 66. The track 12 includes grooves 54 into which a key 24 of the holder 16 is received. The grooves 54 are transverse to a longitudinal length of the track 12. The plurality of grooves 54 are provided such that a position of the holder 16 relative to the clip 14 can be adjusted and maintained during creation of the bracelet to place a tension on the cord. It should be appreciated that although the example loom 10 is shown in multiple pieces, a single integral loom could also be provided with the same features and is within the contemplation of this disclosure.

Figure 2:
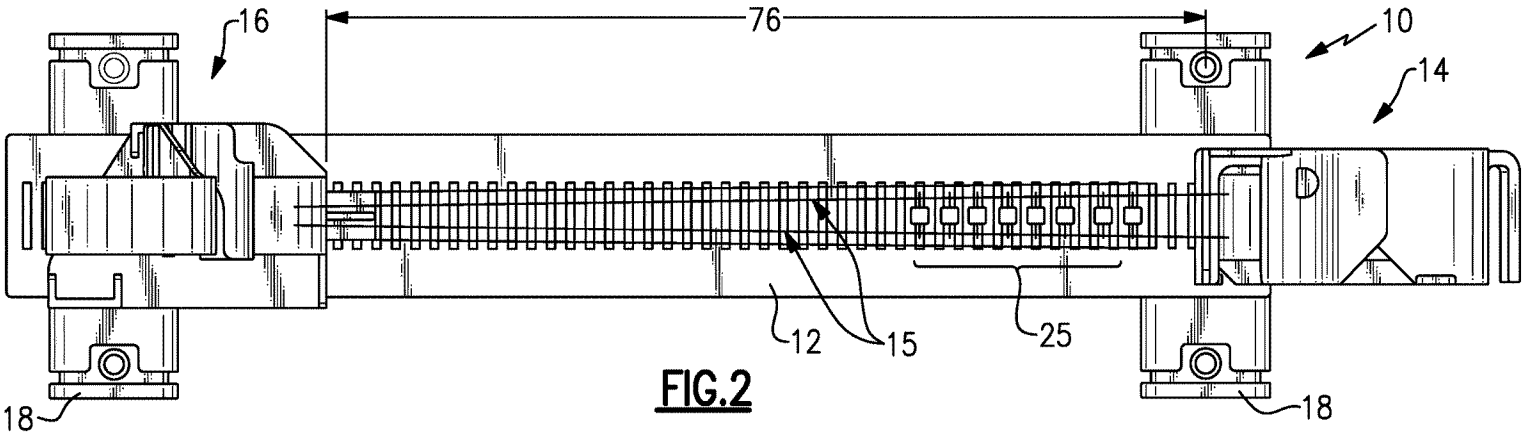
FIG. 2 is a top view of the example bead bracelet loom embodiment.
Figure 3:
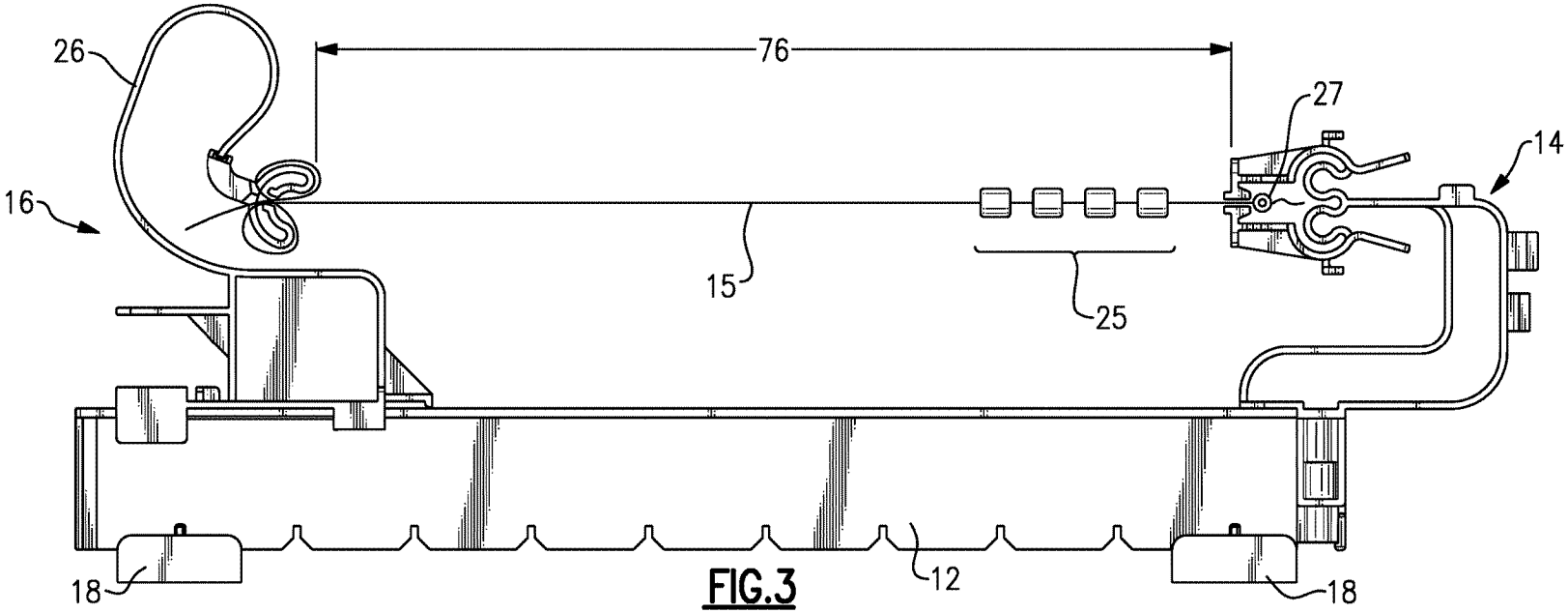
FIG. 3 is a side view of the example bead bracelet loom embodiment.
Figure 4:
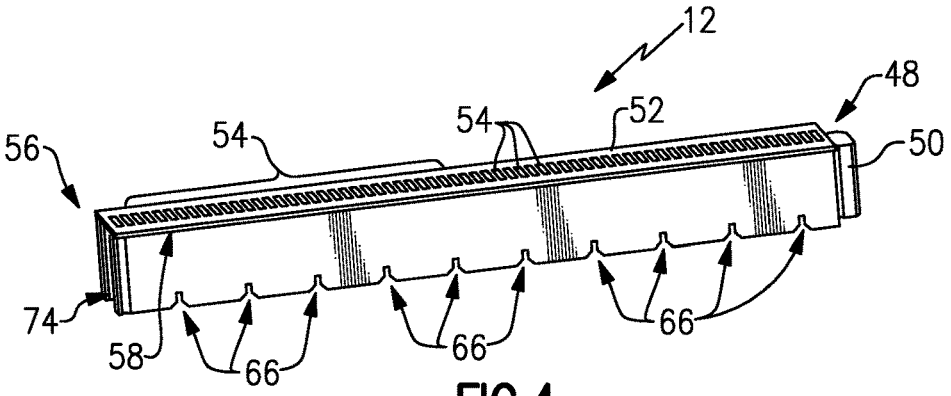
FIG. 4 is a perspective view of an example track.
Figure 5:
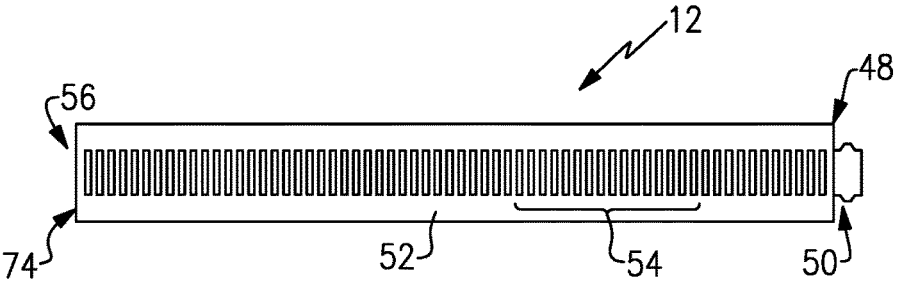
FIG. 5 is a top view of the example track.
Figure 6:
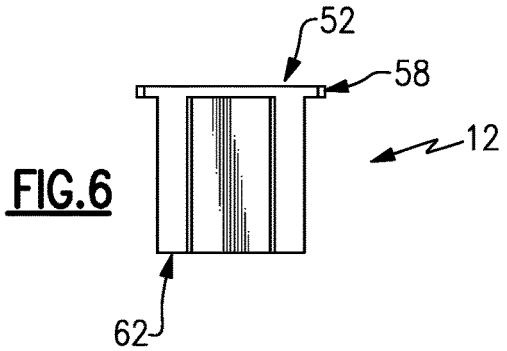
FIG. 6 is an end view of the example track.
Figure 7:
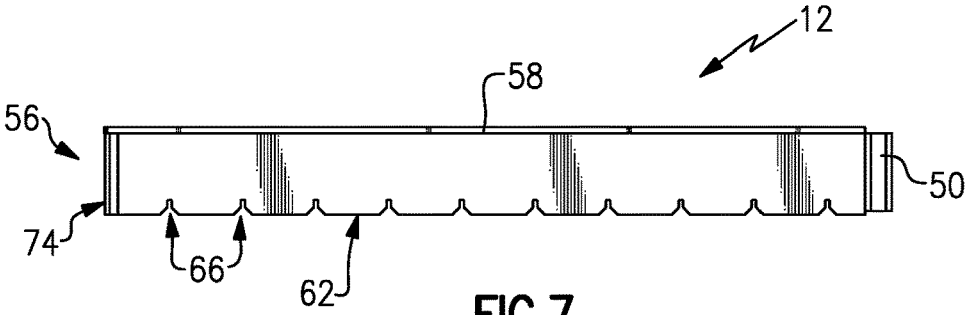
FIG. 7 is a side view of the example track.
Figure 9:
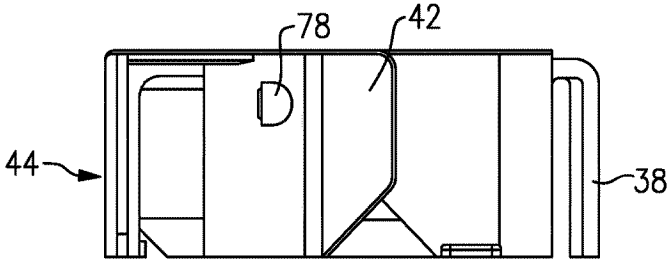
FIG. 9 is a top view of the example clip.
Figure 11:
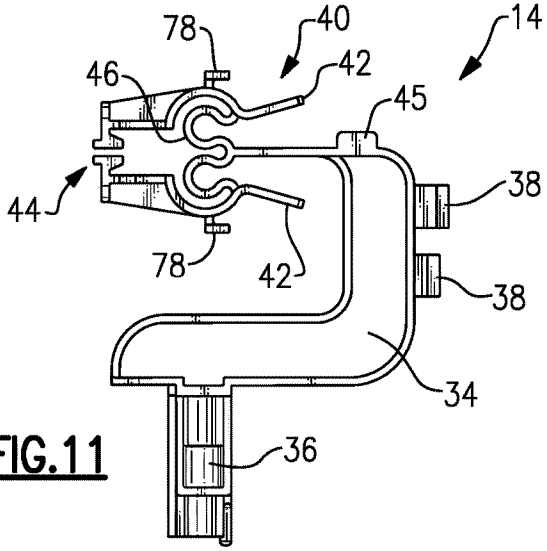
FIG. 11 is a side view of the example clip.
Figure 8:
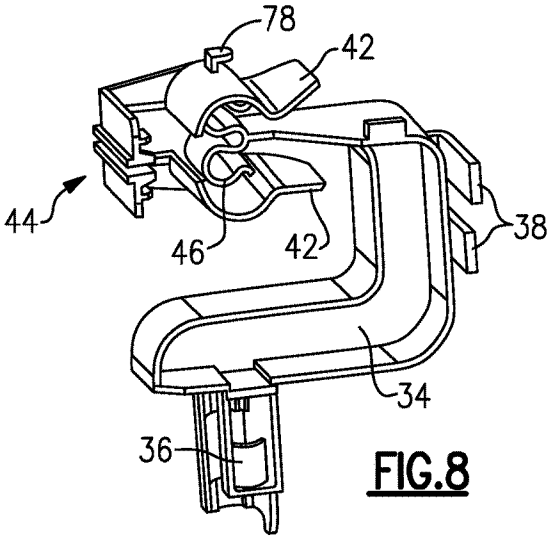
FIG. 8 is a perspective view of an example clip.
Figure 10:
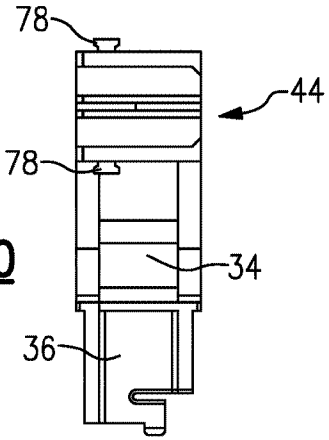
FIG. 10 is an end view of the example clip.
Figure 13:
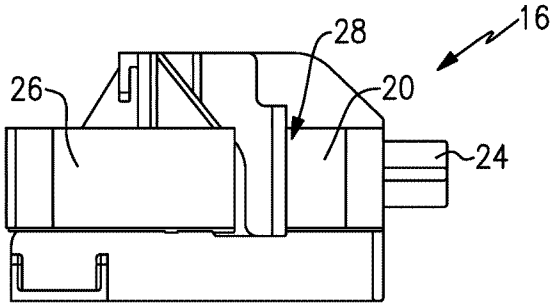
FIG. 13 is a top view of the example holder.
Figure 15:
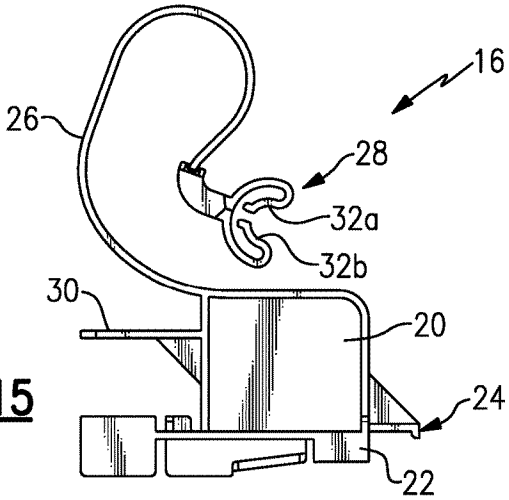
FIG. 15 is a side view of the example holder.
Figure 12:
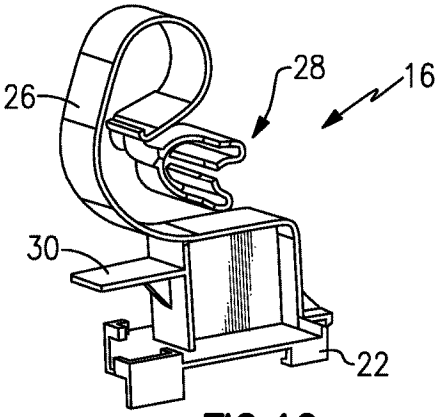
FIG. 12 is a perspective view of an example holder.
Figure 14:
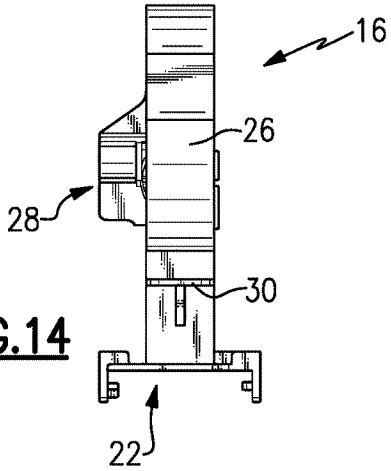
FIG. 14 is an end view of the example holder.
Figure 17:
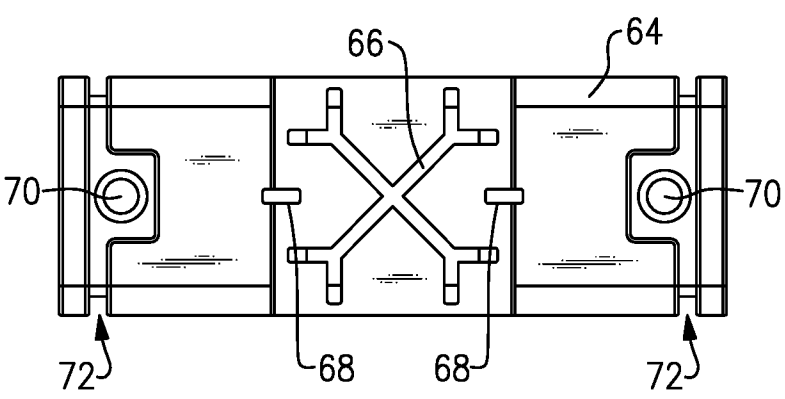
FIG. 17 is a top view of the example leg.
Figure 19:
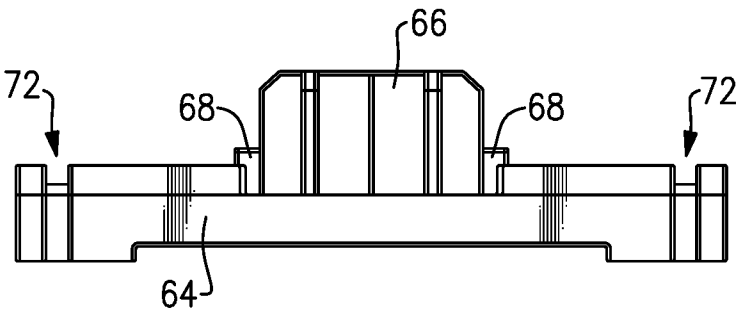
FIG. 19 is a side view of the example leg.
Figure 16:
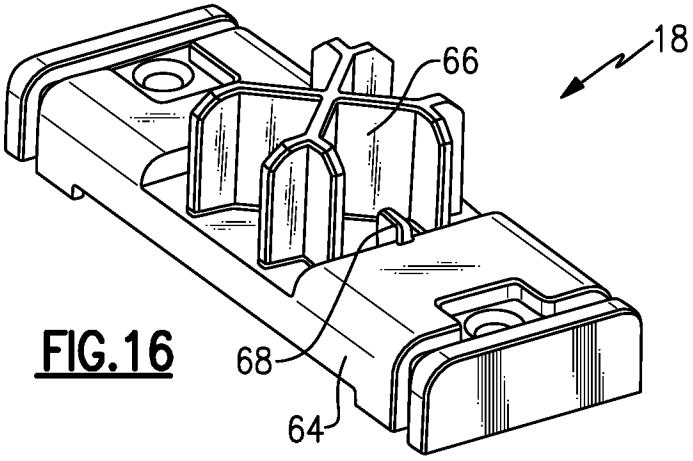
FIG. 16 is a perspective view of an example leg.
Figure 18:
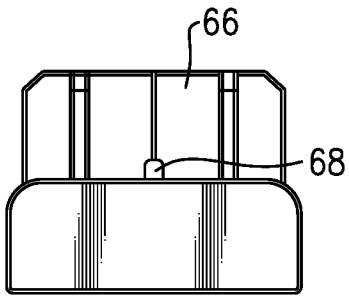
FIG. 18 is an end view of the example leg.

Referring to FIGS. 2 and 3 with continued reference to FIG. 1, cords 15 are shown extended between the holder 14 and the clip 16. Each of the cords 15 are held firmly by the clip 14 and is wrapped around the holder 16. The holder 16 includes a spring portion 26 that provides for the maintaining of a tension on the string of cords 15. Beads 25 may then be threaded onto the longitudinally extending cords 15. The specific size and type of bead 25 is as desired to create the wrap bracelet.

Referring to FIGS. 4, 5, 6 and 7 with continued reference to FIGS. 1-3, the example track 12 is an elongated member that serves as a base portion for the holding a desired distance 76 between the clip 14 and the holder 16. The track 12 includes a plurality of notches 66 that receive leg 18. The track 12 also includes the top surface 52 that includes the plurality of grooves 54. The grooves 54 provide for the holding of the holder 16 relative to the clip 14. In this example, the grooves 54 are disposed transverse to the longitudinal length of the track 12 and enable the setting of a desired distance.

The track 12 also includes a lip 58. The lip 58 provides for engagement of a channel 22 of the holder 16. The holder 16 slides along the top surface 52 of the track 12 with the channel 22 engaged to the lip 58. Tension provided by the cords 15 pull the holder 16 forward such that the holder 16 tilts forward in a direction indicated by arrow A (FIG. 1) to engage that the key 24 engages one of the grooves 54.

The example track 12 includes a first end 50 and a second end 56. The first end 50 provides for mounting of the clip 14. The second end 56 includes a key 74. The key 74 is configured to receive the first end 50 of another track 12 such that additional tracks 12 may be attached to each other to extend a desired length. In other words, the first end 50 of one track 12 may be inserted into the key 74 on the second end 56 to provide double the length of one track 12. As appreciated, multiple numbers of tracks 12 can be utilized to provide any length desired.

Referring to FIGS. 8, 9, 10 and 11 with continued reference to FIGS. 1, 2 and 3, the example clip 14 is illustrated and includes a base 34. The base 34 includes a post 36. The post 36 is attached to the first end 50 on the track 12. The base 34 includes a guide 45 and supports clips 38 along a back side. The clips 38 are utilized for securing the cords 15 and also may guide portions of cord that are not currently being beaded.

The clip 14 includes the clipping end 40 that includes opening jaws 44. The opening jaws 44 are bias towards a closed position by a spring 46. Tabs 42 are provided on the spring 46 to enable opening of the jaws 44. A cord 15 is inserted or attached to the jaws 44 to secure one end of the cord 15. The jaws 44 can also be used to secure the cord 15 and include the spring member 46 that biases the jaws 44 closed to hold one end of the cord 15 in a desired position. Tabs 78 are provided on the top and bottom portions of the jaws 44 to provide another optional location to secure an end of the cord 15 during fabrication of the wrap bracelet.

Referring to FIGS. 12, 13, 14 and 15 with continued reference to FIGS. 1, 2 and 3, the example holder 16 includes the spring portion 26 and a clip portion 28. The clip portion 28 includes a first arm 32*a* and a second arm 32*b*. An end of a cord 15 is woven around the arms 32*a* and 32*b* of the holder 16 and then around the spring portion 26. The holder 16 is then pulled along the channel 12 to generate a desired amount of tension on the cord 15. The entire holder 16 will then rock forward in the direction indicated by arrow A (FIG. 1) such that the key 24 engages a corresponding groove 54 to hold the holder 16 at a desired distance 76 (FIGS. 2 and 3).

The key 24 is provided at a forward portion of the holder 16 and forward of a channel 22 on the holder 16. The channel 22 engages the lip 58 defined on the track 12. A tab 30 is provided on a back side of the holder 16 that is the side opposite of the key 24. The tab 30 is provided such that it may be pressed downward to disengage the key 24 from the groove 54 within the track 12. By releasing the key 24, tension can be removed from the cord 15 such that the cord may be removed from the loom when it is completed.

Referring to FIGS. 16, 17, 18 and 19 with continued reference to FIGS. 1, 2 and 3, example legs 18 are provided on either side of the track 12 to provide a consistent and solid foundation for the track 12. Each of the legs 18 includes a key 66. The key 66 is configured to engage the open channel of the track 12 between the bottom side notches 62. The legs 18 are fit into the open bottom channel of the track 12 and include tabs 68 that engage the notches 62 defined along the length of each of the track 12. The different notches 62 enable the legs 18 to be moved to a desired position on the track 12. As appreciated, because the track 12 may be extended by adding additional tracks through insertion of the first end 50 into the keyway 74 of an additional track 12, additional legs may be utilized along any portion of the track to provide the desired amount of stabilization.

Each of the legs 18 include openings 70 that enable mounting to a fixed surface if desired. Moreover, each of the legs 18 include a notch 72 that can be further utilized to aid in fixing the loom 10 to a surface such that it will not move around during fabrication of a wrapped bead or other type of beaded item. It should be understood that the legs 18 could also be configured as integral features to the track 12 and loom, and that such a configuration is within the contemplation of this disclosure.

Figure 22A:
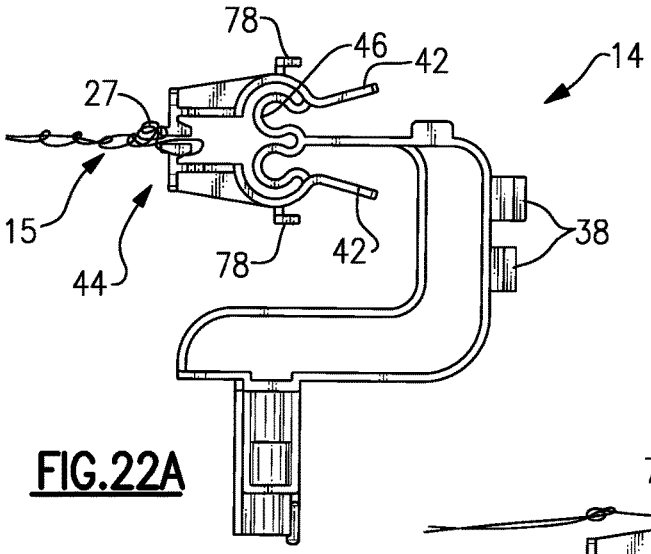
FIG. 22A is a side view of the clip holding a portion of cord according to one example embodiment.
Figure 22B:
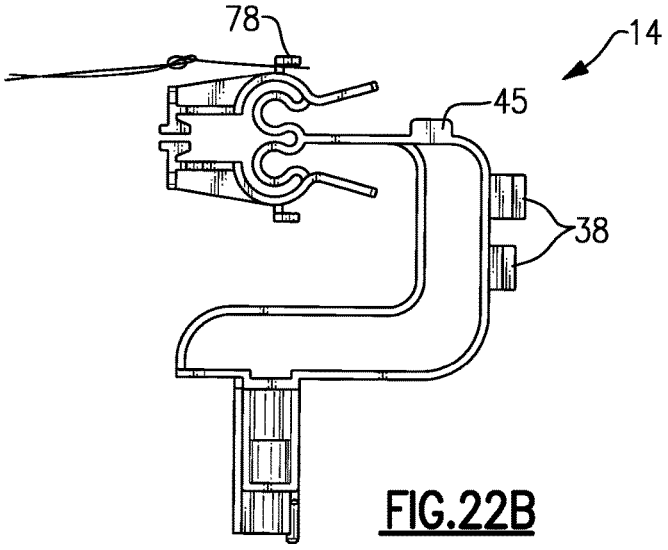
FIG. 22B is a side view of the clip holding a portion of cord according to another example embodiment.
Figure 22C:
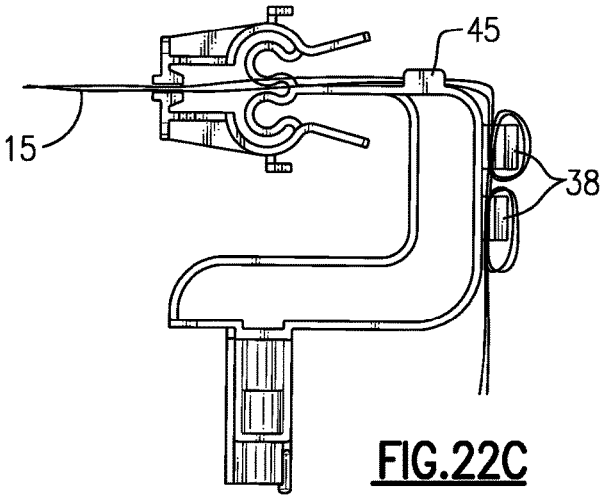
FIG. 22C is a side view of the clip holding a portion of cord according to yet another example embodiment.
Figure 23A:
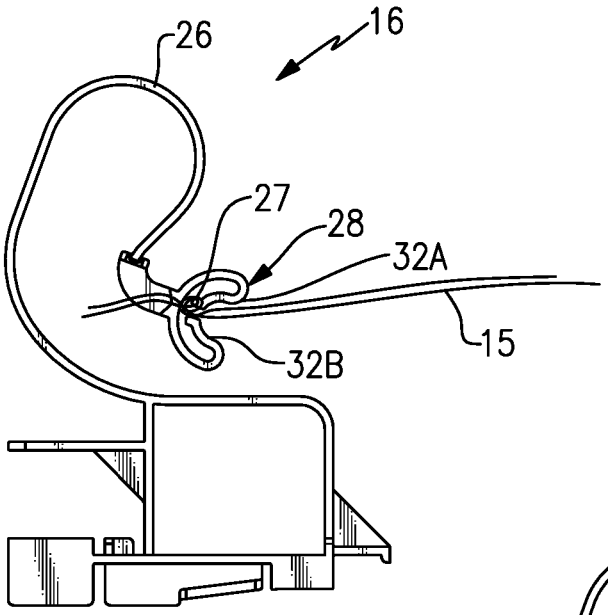
FIG. 23A is a side view of the holder holding a portion of cord according to one example embodiment.
Figure 23B:
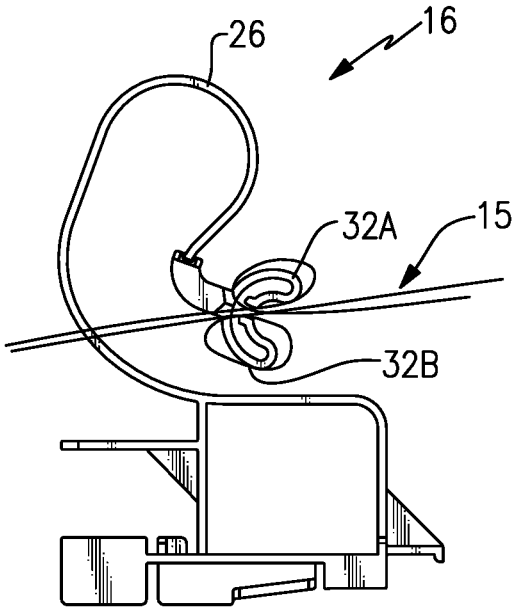
FIG. 23B is a side view of the holder holding a portion of cord according to one example embodiment.

Referring to FIGS. 1-3, creation of wrap bracelet includes an initial step of securing two cords 15 (FIGS. 2 and 3) to the clip 14. The cords 15 may be tied, to the tabs 78 or 38. The cords 15 may also be tied into a knot 27 and secured between the jaws 44. The jaws 44 are configured such that tension on the cord 15 pulls the jaws such that the further tighten against the cords 15. The other end of the cored 15 is then inserted into the holder 16. The cord 15 may be tied into a knot 27 and inserted between the arms of the clip 28, or wrapped around the clip 28. FIGS. 22A-C illustrate example methods for securing the cord to the clip 14. FIGS. 23 A-B illustrate example methods of securing the cord 15 to the holder 16.

Once the cord 15 is secured between the clip 14 and the holder 16, the holder 16 is pulled away from the clip 14 to place tension on the cords 15. The tension causes the holder 16 to tip forward in the direction indicated by arrow A such that the key 24 engages a groove 54 to hold it in a desired position. The tension provided by the cord and the spring 26 holds the holder 16 in place while beads 25 are tied between the cords 15.

Figure 20:
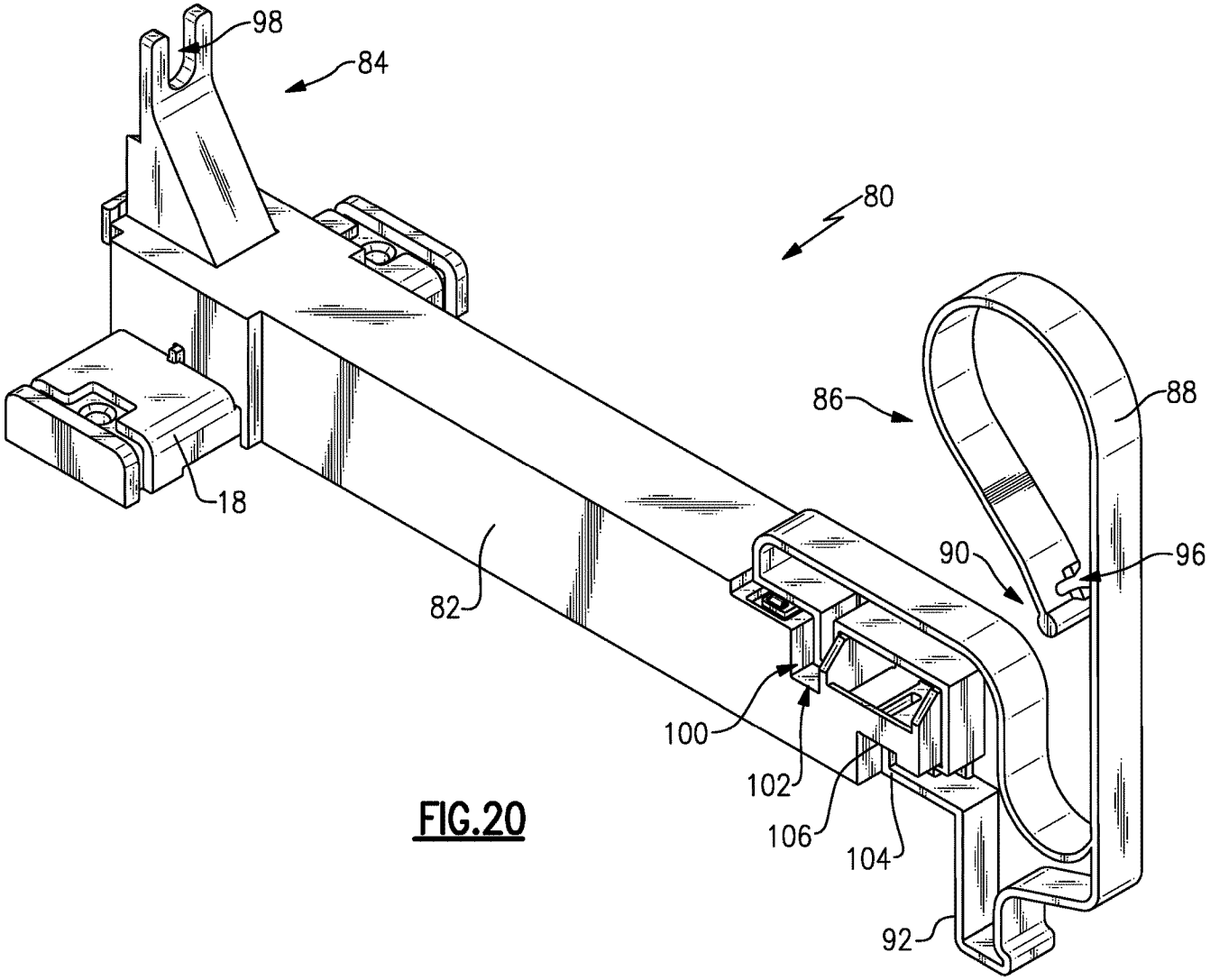
FIG. 20 is a perspective view of another example bead loom embodiment.
Figure 21:
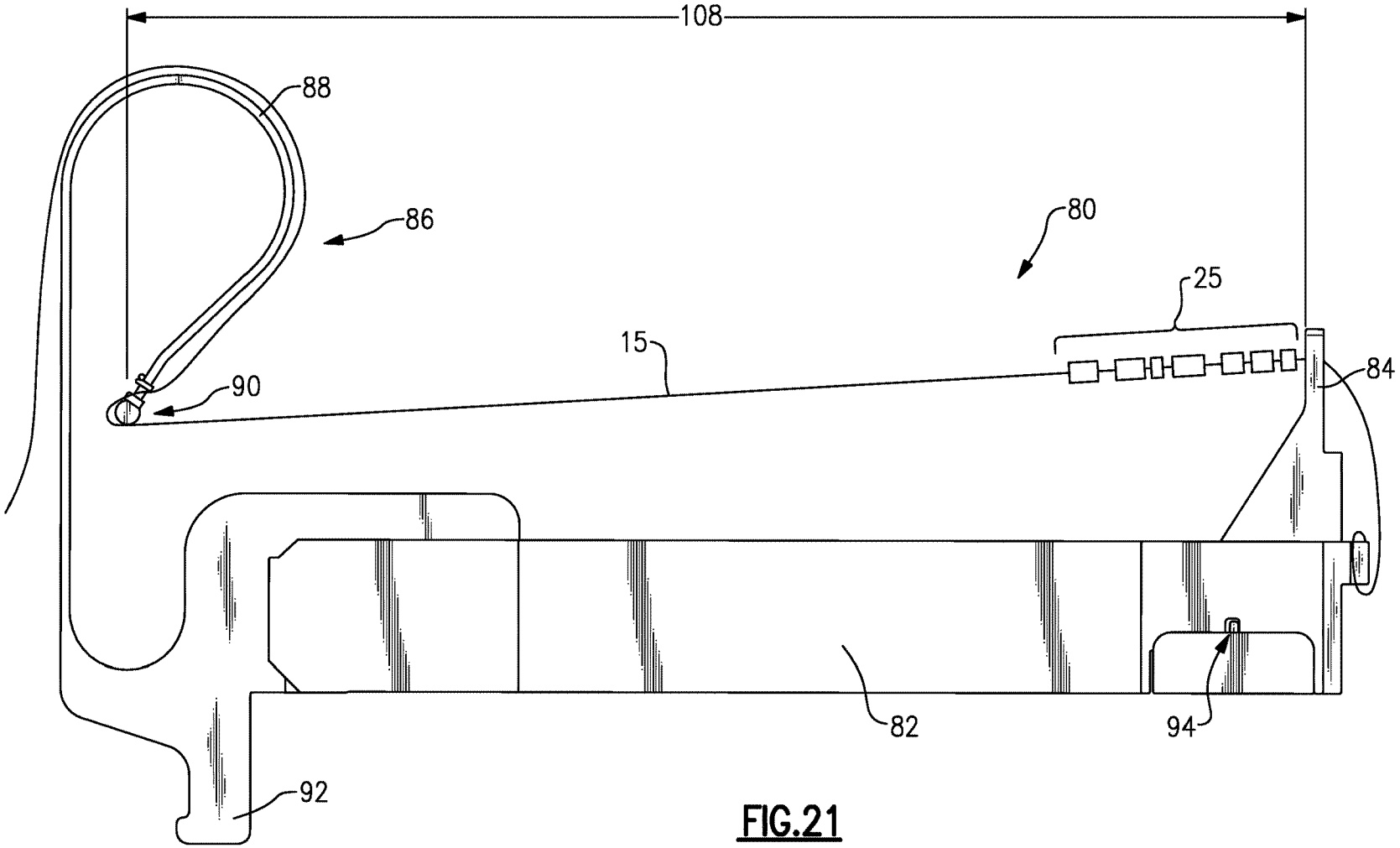
FIG. 21 is a side view of the example bead loom of FIG. 20.

Referring to FIGS. 20 and 21, another loom 80 is disclosed that includes an integral base holder and clip. In this example, the clip 84 is integrally formed with the base 82. The holder 86 may also be integrally formed with the base 82 but may also be a separate portion as is disclosed in FIGS. 20 and 21. In this configuration, the holder 86 includes tab 102 and 106 that are received within corresponding slots 100 and 104. The example holder 86 also includes a foot portion 92 that is configured to engage the edge of a table to hold the loom 80 in a desired position while attaching beads to cords extended between the clip 84 and the holder 86.

A cord 15 is secured through the clip 84 on one end and then extended to the holder 86 at another end. The holder 86 includes a spring portion 88 and an end portion 90 including slot 96. An end of the cord 15 is inserted into the slot 96 and secured to the end portion 90. The end of the cord 15 is wound around the end portion 90 through the slot 96 and around the spring portion 88 of the holder 86. A tension is then drawn on the cord 15 that pulls the spring 88 into a position where a tension is generated on the cord 15. Beads 25 may then be woven onto the cords 15 to provide the desired design of the wrap bracelet in the same manner illustrated in FIGS. 2 and 3.

The example base 82 may also be supported and utilized a leg 18 as is previous disclosed and described above. The example loom 80 provides a fixed distance between the spring 86 of the holder 86 and the clip 84. No adjustment is provided with the loom 80. As appreciated, in some instances, variable distances are not required and an integral loom such as that disclosed by the loom 80 is sufficient to provide fabrication of a wrap bracelet.

Accordingly, the disclosed looms 80 and 10 provide for the fabrication of a wrap bracelet by holding a cord at a tension between a clip 14 and a holder 16. The holder 16 includes a spring portion to hold a desired tension on the cords 15 during fabrication of the wrap bead bracelet. While the disclosed loom 10 is made from multiple features it is within the contemplation of this disclosure that an integral structure could also be utilized that includes a clip and a spring structure supported a distance away from the clip portion. For that reason, the disclosed loom 80 includes integral structures that are formed as one piece or pieces that are fixed relative to one another once assembled but still provide for fixing the cord on one end and providing a spring bias to maintain a desired tension on a string on a second end.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A loom for creating a beaded bracelet, the loom comprising:

a track;

a clip disposed at one end of the track and configured to hold a portion of a cord; and a holder disposed on the track and spaced apart from the clip, the holder including a key that engages a portion of the track to maintain a position of the holder spaced apart from the clip, the holder including spring portion holding a cord clip portion configured to hold another portion of the cord and maintain a desired tension on the cord between the clip and the holder, wherein the spring portion of the holder comprises a curved shape extending from a base portion, the clip portion disposed on end of the curved shape for extending the desired tension on the cord.

2. The loom as recited in claim 1, wherein the holder includes a channel portion and the track includes a lip portion, the channel portion of the holder receives the lip of the track to hold the holder in position to set a distance between the holder and the clip.

3. The loom as recited in claim 2, wherein the track includes a plurality of grooves and the key portion of the holder is receivable within one of the one of the plurality of grooves for setting the distance between the holder and the clip.

4. A loom for creating a beaded bracelet, the loom comprising:

a track;

a clip disposed at one end of the track and configured to hold a portion of a cord; and a holder disposed on the track and spaced apart from the clip, the holder including a key that engages a portion of the track to maintain a position of the holder spaced apart from the clip, the holder including spring portion holding a cord clip portion configured to hold another portion of the cord and maintain a desired tension on the cord between the clip and the holder, wherein the track includes a first end portion and a second end portion, the first end portion and the second end portion including one of a tab and a key for attaching additional tracks to extend the track beyond the length of a single track.

5. The loom as recited in claim 4, wherein the clip includes a post portion that is attached at one end of the track and a base portion.

6. The loom as recited in claim 5, wherein the clip includes opening jaws at an end of the base portion, wherein the jaws include a spring member that biases the jaws toward a closed position for holding a portion of the cord.

7. The loom as recited in claim 1, including legs that are attachable to the track.

8. The loom as recited in claim 1, wherein the clip, holder and track comprise a single integral part.

9. The loom as recited in claim 1, wherein the clip, holder and track are separate components.

10. A method of fabricating a loom for use in creating a beaded item, the method comprising:

providing a track including distal ends;

providing a clip for holding a first portion of a cord on one end of the track; and providing a holder for holding a second portion of the cord a distance from the clip, wherein the holder is defined to include a key portion for maintaining a position of the holder relative to the clip to generate a desired tension on the cord between the clip and the holder, wherein the holder includes a curved shape spring portion extending from a base and the clip is disposed on end of the curved shape spring portion for exerting the desired tension on the cord.

11. The method as recited in claim 10, including defining the track to include grooves for receiving the key portion to maintain the position of the holder relative to the clip.

12. The method as recited in claim 10, wherein the track and clip are configured as one integral part.

13. The method as recited in claim 10, wherein the track, clip and holder are configured as multiple pieces with the track supporting the clip and the holder.

14. A method of creating a beaded item with a loom, the method comprising:

securing a first end portion of a first cord to a clip disposed at an end of a track;

securing a second end portion of the first cord to a holder spaced apart from the clip on the track such that a tension is generated on the first cord, wherein the holder comprises a curved shape spring portion and the clip is disposed on an end of the curved shape spring portion for exerting the desired tension on the cord; and attaching at least one bead to the first cord with a thread separate and distinct from the first cord.

15. The method as recited in claim 14, including attaching additional beads to the first cord with one of the thread and a plurality of additional threads.

16. The method as recited in claim 14, including securing one end of the first cord with jaws of the clip biased toward a closed position with a spring.

17. The method as recited in claim 14, including generating the tension on the first cord with a spring portion of the holder by moving the holder away from the clip along the track.

18. The method are recited in claim 14, wherein the first cord comprises at two separate cords supported between the clip and the holder and the thread is attached to each of the two separate cords.

* * * * *